United States Patent [19]

Clark

[11] Patent Number: 4,695,265

[45] Date of Patent: Sep. 22, 1987

[54] PUPPET APPARATUS

[76] Inventor: Maynard H. Clark, 8E Butler Ave., Chalfont, Pa. 18914

[21] Appl. No.: 848,656

[22] Filed: Apr. 7, 1986

[51] Int. Cl.[4] ..... A63H 3/14

[52] U.S. Cl. ..... 446/329; 446/339

[58] Field of Search ..... 446/329, 327, 337, 338, 446/339, 359, 361, 362

[56] References Cited

U.S. PATENT DOCUMENTS

| | | | |
|---|---|---|---|
| 2,114,851 | 4/1938 | McCown | 446/329 |
| 2,633,670 | 4/1953 | Steuber | 446/329 |
| 2,725,670 | 12/1955 | Hodes | 446/327 |
| 2,771,708 | 11/1956 | Enison . | |
| 3,526,990 | 9/1970 | Edmonds | 446/327 |
| 3,900,991 | 8/1975 | Kosicki et al. . | |

*Primary Examiner*—Mickey Yu

*Attorney, Agent, or Firm*—Beveridge, DeGrandi & Weilacher

[57] ABSTRACT

A puppeteer's kit includes a puppet and a disguise with a mustache for concealing the puppeteer's lip movements during a performance. The puppet has an internally located actuator lever which is movable in a horizontal direction to turn the head from side-to-side and in a vertical direction to move the mouth or another facial feature of the puppet. The puppeteer's thumb extends upwardly through an opening in the lower wall of the puppet body to the rear end of the actuator lever. The rear end of this lever has two surfaces which face toward each other and are spaced apart to receive a puppeteer's thumb. These surfaces are inclined downwardly and rearwardly to enable the puppeteer's thumb to engage the lever effectively during head movements, both when the lever is at its center position and at positions which are rotationally displaced therefrom.

12 Claims, 4 Drawing Figures

FIG 2
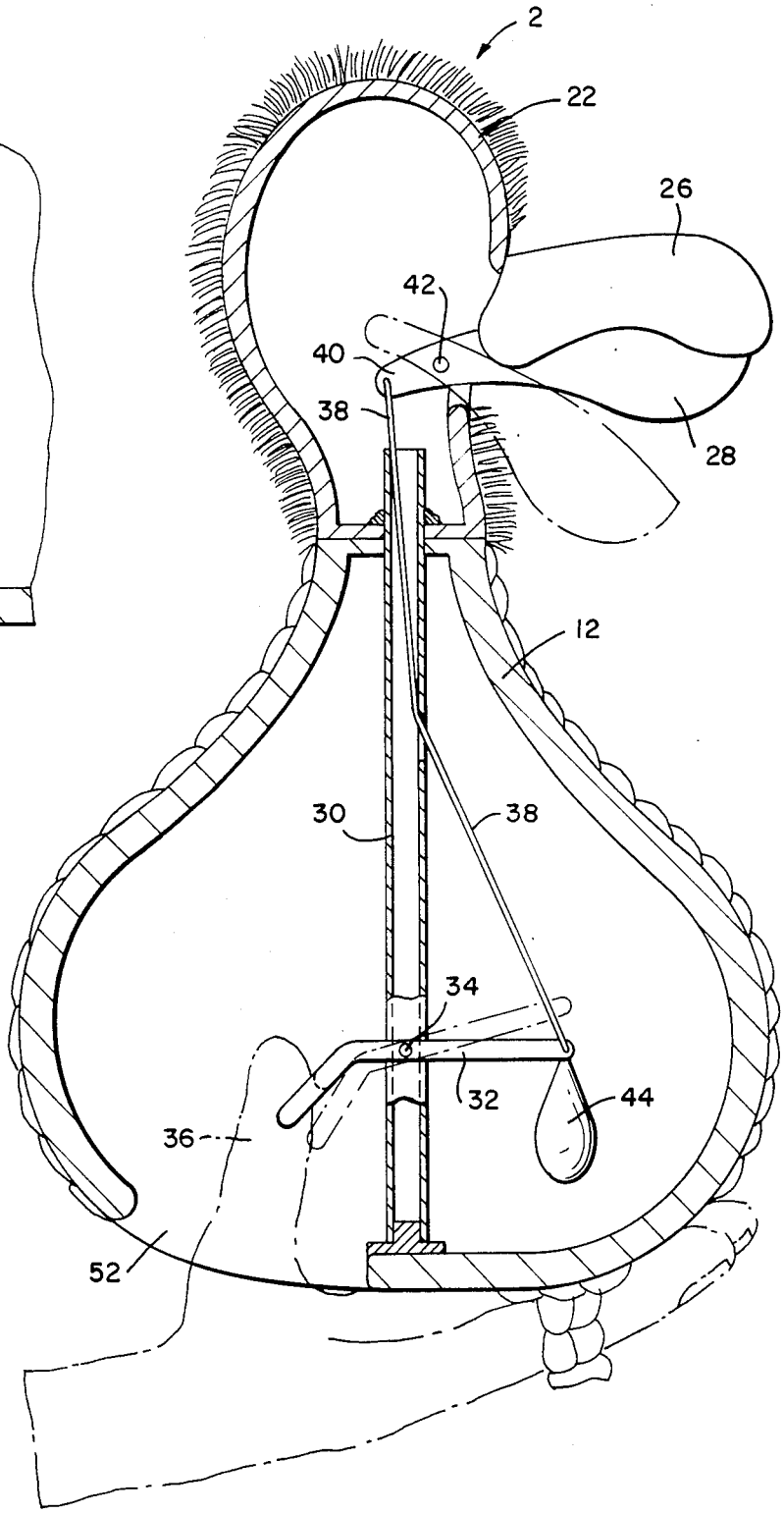
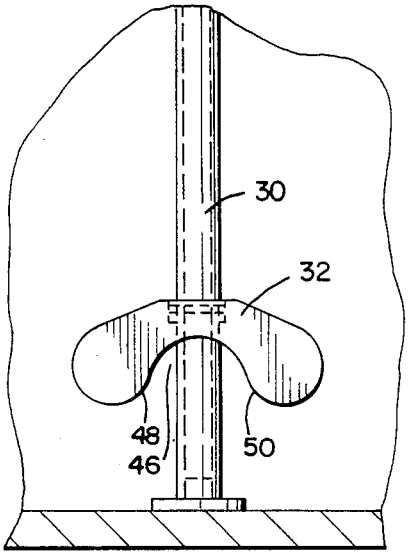
FIG 3
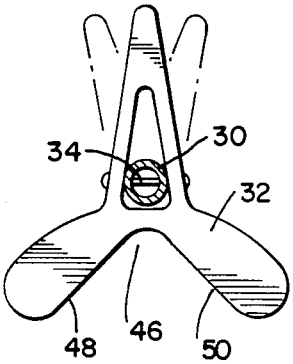
FIG 4

PUPPET APPARATUS

BACKGROUND OF THE INVENTION

This invention pertains to a puppet and a puppeteer's kit which are used for performing puppet shows. In one respect, the invention relates to the structure of a puppet and, in another respect, the invention involves a kit which includes a disguise for concealing the puppeteer's lip movements.

Prior to this invention, there have been numerous designs and styles of puppets ranging from the very simple three finger puppets to very complex puppets with numerous internal mechanisms for facial and body movements.

The present invention pertains in part to a puppet with a very simple mechanism which permits one handed operation for supporting the puppet and for providing compound movements. These movements involve the turning of the head and the movement of a facial element such as a movable jaw which causes the mouth of the puppet to open and close. In addition to being simple and uncomplicated, the mechanism of this invention is quite easy to use, even for a novice, which makes it especially well suited for children who are aspiring puppeteers.

The invention also pertains to a kit which includes a disguise for concealing the lip movements of the puppeteer, thus making it possible for the puppeteer to provide the puppet's voice without resorting to the difficult skills of ventriloquism.

SUMMARY OF THE INVENTION

This invention involves improvements in a puppet of the type which has a head which is pivotally movable on a body in order to turn with respect to the body, a face which has a facial element movably mounted thereon, and an actuator member which is located inside the body and is movable by a puppeteer to turn the head relative to the body and to move the facial element relative to the head. The actuator member is movable in a first direction to turn the head relative to the body, and it is also connected to the facial element and is movable in a second direction to move the facial element relative to the head.

In one respect, the invention represents an improvement wherein the actuator has two surfaces which face toward each other and are spaced apart to receive therebetween a puppeteer's thumb or finger which is parallel to the pivot axis of the head.

In another respect, the invention involves a puppet of this type wherein the puppet body has a bottom wall provided with an opening for receiving the puppeteer's thumb, thereby permitting the thumb to extend upwardly into the body to engage the actuator member.

In connection with the invention summarized above, the movable facial element may be a jaw which is moved to open and close the puppet's mouth. Further, an artificial thumb is mounted on the exterior of the puppet's body where it is visible to provide the illusion that the puppeteer's thumb is outside the body. As to the details of the actuating mechanism, the actuator member preferably is a lever which is mounted on vertical and horizontal pivots. The vertical pivot is coincident with the axis of head rotation and it permits movement of the lever in a first direction to turn the head from a center position to positions which are laterally displaced from the center position. The horizontal pivot permits movement of the lever in a second direction to move the facial element relative to the head. The lever has first and second lever arms located on opposite sides of the horizontal pivot. The first arm is engaged by the puppeteer's thumb, and the second arm is connected to the movable facial element. The first lever arm is inclined downwardly and rearwardly at all positions of the lever, this disposition enabling the puppeteer's thumb to engage the lever effectively both when the lever is at the center position and at the laterally displaced positions.

The invention also involves a puppet which is packaged together with a disguise and may be sold as a kit. The disguise includes an artificial mustache means which conceal the puppeteer's lips and prevents members of an audience from seeing his lip movements during a performance. This disguise preferably includes an eyeglasses frame and an artificial nose arranged so that the mustache, frame and nose are connected together.

Other features of the invention will be understood from the following disclosure of a preferred embodiment.

BRIEF DESCRIPTION OF THE DRAWINGS

FIG. 2 is a sectional view through the puppet which shows the actuating mechanism thereof.

FIG. 3 is a rear elevational view of the actuating lever and its supports; and FIG. 4 is a downwardly-looking view of the actuating member and its supports.

DETAILED DESCRIPTION

Figure 1:
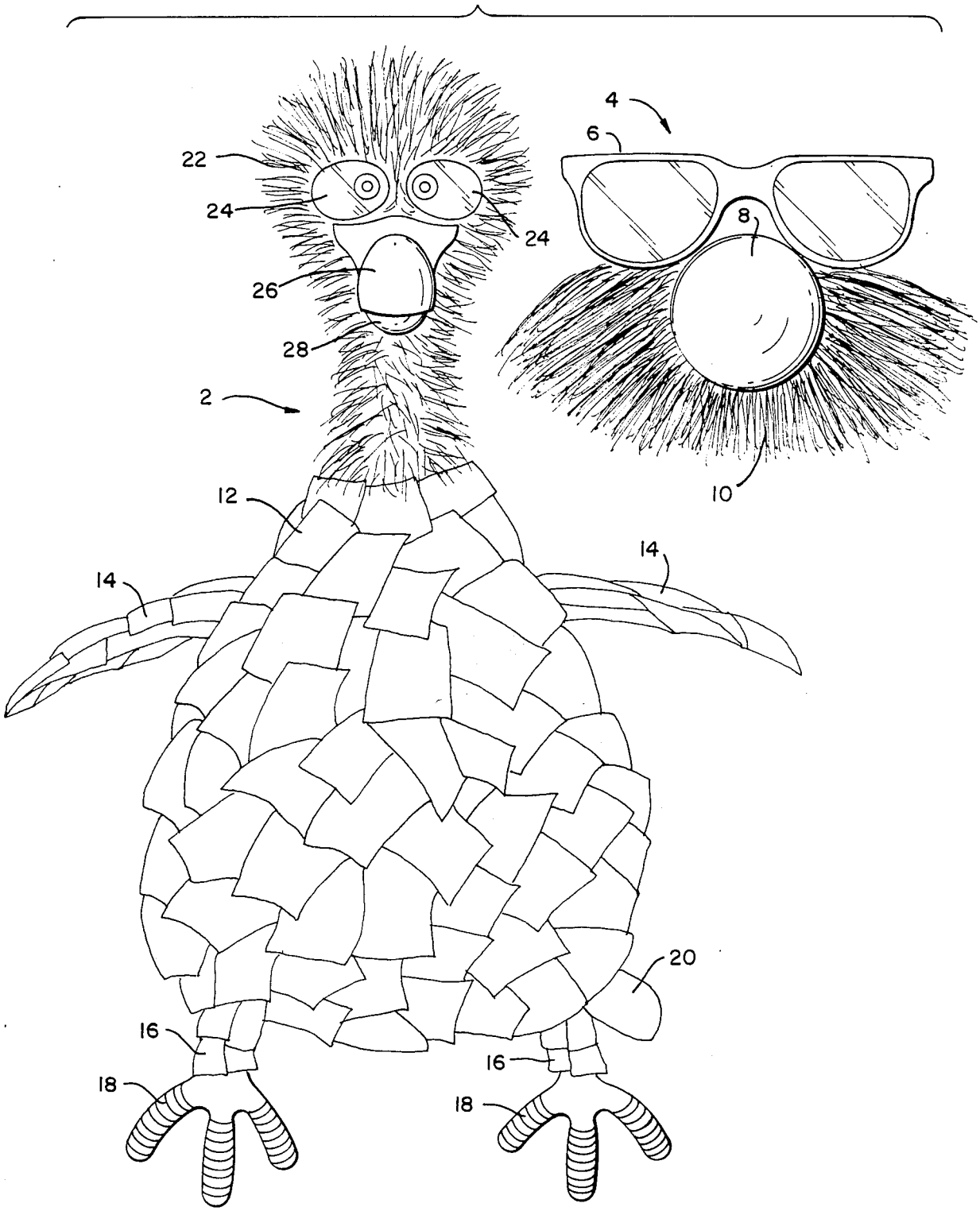
FIG. 1 shows a puppeteer's kit which includes a puppet and a puppeteer's disguise.

FIG. 1 shows a puppeteer's kit which includes a puppet 2 and a disguise 4. The disguise is worn by the puppeteer, primarily for the purpose of concealing his lips when he is using his voice to speak for the puppet. This disguise includes an eyeglasses frame 6, an enlarged bulbous nose 8 attached to the eyeglasses frame, and an artificial mustache 10 formed of filamentary material and supported by the nose 8 and/or frame 6. The mustache 10 is quite large so that it will cover the lower portion of a performer's face, concealing his lips and preventing the audience from seeing any lip movements which occur during a performance.

The puppet 2 has a pear-shaped body 12 with a feather-like exterior covering, movable wings 14, legs 16, and claws 18. At the lower portion of the body and exteriorly mounted on the side thereof, there is an artificial thumb 20 which, as will be understood below, provides the illusion that the puppeteer's thumb is located outside the body when, in fact, the puppeteer's thumb extends into the body to actuate the mechanism.

The head 22 of the puppet is mounted on the body and is turnable from side-to-side by the mechanism which is described later in this specification. The face of the puppet includes eyes 24 and beak structure 26 which for purposes of this description will be referred to as a mouth. The lower beak or jaw 28 is movable in order to open or close the mouth during simulated speaking actions by the puppet.

The simple and effective mechanism for turning the head and moving the jaw is illustrated in FIGS. 2, 3 and 4. Here, it will be seen that there is a centrally located vertical tube which is nonrotatably attached to the head 22 and is pivotally supported on the body 12. As will be apparent, the axis of the tube 30 is coincident with the rotational axis of the head with respect to the body. An actuator lever 32 is pivoted at 34 to the tube 30 and is engageable by the puppeteer's thumb 36 which extends generally parallel to the rotational axis of the tube 30. The forward arm of the lever 32 is connected by a stiff wire 38 to an interior extension 40 of the lower beak or jaw 28. The jaw 28 is mounted on the head by a pivot 42. A counterweight 44 is placed at the forward end of the lever to bias the lever 32 in a clockwise direction as shown in FIG. 2, tending to move the jaw 28 to the closed position shown in solid lines.

The rear arm of the actuator lever 32 is configured to receive the puppeteer's thumb which is generally vertical as can be seen in FIG. 2. The rear end of the lever 32 is inclined downwardly and rearwardly at all positions of the lever so that the puppeteer's thumb is able to engage the lever both when the lever is at the center position and in any laterally displaced positions which it may assume when the head is turned from side-to-side.

Referring to FIGS. 2 and 3, it will be seen that the rear end of the lever has two opposed trailing portions which define therebetween a thumb-receiving recess 46. This recess or indentation is bounded on its left and right sides by two surfaces 48 and 50 which face toward each other and are spaced apart in order to receive therebetween the puppeteer's thumb. When the puppeteer uses his left hand as shown in FIG. 2, the surface 48 will be contacted primarily by the thumbnail side of the thumb, whereas the surface 50 will be contacted primarily by the pad side of the thumb.

When the head is turned from side-to-side, it will be recognized that the distance which the thumb must reach to the actuator lever will be greater than if the head is at its center position. It will also be appreciated that, because the lever arm is inclined downwardly and rearwardly, it is more convenient for the puppeteer to keep his thumb in proper engagement with the actuating lever, as the thumb is able to slide down to a lower point on the lever when the head is at a rotationally displaced position.

When using the puppet constructed according to the invention, the puppeteer supports it in the palm of his hand as can be seen in FIG. 2. The puppeteer's thumb extends upwardly through the opening 52 located in the bottom wall of the body 12. When the thumb is in this position and seated between the surfaces 48 and 50 of the actuator lever, the puppeteer is able to move the lever in a first direction which is horizontal in order to turn the head from side-to-side. The puppeteer is also able to move the lever in a second direction which is vertical, thus moving the lever about the pivot 34, raising the forward end of this lever and causing the wire 38 to exert an upward force on the rear extension 40 of the puppet's jaw 28, thus causing the puppet's mouth to move to the open position as represented by the dot-dash lines.

Although the puppeteer's thumb is active throughout the performance to move the head and jaw, this fact will be concealed because, as shown in FIG. 1 and as mentioned above, an artificial thumb 20 is exteriorly mounted on the puppet body. Thus, the members of the audience will see the four fingers and apparent thumb of the puppeteer, and they will not be conscious of the fact that the puppeteer's real thumb is actively operating the internal puppet mechanism. As to this mechanism, it is possible and desirable to provide filaments which can be engaged by the thumb and are operatively connected with inner levers connected to the wings 14, thus enabling the puppeteer to flap the wings 14 at an appropriate time during the performance.

Persons familiar with the field of this invention will appreciate that it may take many forms other than the preferred embodiment described above. Therefore, it is emphasized that the invention is not limited solely to this embodiment but is embracing of modifications thereto and variations thereof which fall within the spirit of the following claims.

I claim:

1. A puppet which is operable by one hand of a puppeteer, comprising, a body, a head mounted on the body, said head being mounted for pivotal movement about a first axis in order to turn with respect to the body, said head having a face provided with a facial element which is movably mounted on the head, an actuator member located inside said body and being movable by the puppeteer to turn the head relative to the body and to move the facial element relative to the head, said actuator member being connected to the head and being movable in a first direction of travel to turn the head relative to the body, said actuator member being connected to the facial element and being movable in a second direction of travel to move the facial element relative to the head, said second direction of travel being different from said first direction of travel, said actuator having two surfaces which face toward each other and are spaced apart to provide a horizontal space for receiving therebetween a puppeteer's thumb which is parallel to said first axis, said surfaces being elongated in directions which extend away from said first axis.

2. A puppet according to claim 1 wherein the face has a mouth, and the movable facial element is a jaw which is moved to open and close the mouth.

3. A puppet according to claim 1 having an artificial thumb which is exteriorly mounted on the body, said artificial thumb being visible to provide an illusion that the puppeteer's thumb is outside the body.

4. A puppet according to claim 1 wherein the body has a bottom wall provided with an opening for receiving the puppeteer's thumb to permit the puppeteer's thumb to extend upwardly into the body and engage the actuator member.

5. A puppet according to claim 1 wherein the actuator member is a lever which is mounted on a vertical pivot and a horizontal pivot, said vertical pivot being coincident with said first axis and permitting movement of said actuator member in said first direction to turn the head from a center position to positions which are rotationally displaced from said center position, said horizontal pivot permitting movement of said actuator member in said second direction to move the facial element relative to the head, said lever having first and second lever arms located on opposite sides of the horizontal pivot, said first lever arm being engageable by the puppeteer's thumb, and said second lever arm being connected to said movable facial element.

6. A puppet according to claim 5 wherein said first lever arm is inclined downwardly and rearwardly at all positions of the lever to enable the puppeteer's thumb to engage the lever both when the lever is at said center position and at said rotationally displaced positions.

7. A puppet which is operable by one hand of a puppeteer, comprising, a body, a head mounted on the body, said head being mounted for pivotal movement about a first axis in order to turn with respect to the body, said head having a face provided with a facial element which is movably mounted on the head, an actuator member located inside said body and being movable by the puppeteer to turn the head relative to the body and to move the facial element relative to the head, said actuator member being connected to the head and being movable in a first direction of travel to turn the head relative to the body, said actuator member being connected to the facial element and being movable in a second direction of travel to move the facial element relative to the head, said body having a bottom wall provided with an opening for receiving the puppeteer's thumb to permit the puppeteer's thumb to extend upwardly into the body and engage the actuator member, said body having an exposed exterior surface which is located forwardly of said opening and provides a site for placing a puppeteer's fingers where they will be visible to an audience.

8. A puppet according to claim 7 wherein the face has a mouth, and the movable facial element is a jaw which is moved to open and close the mouth.

9. A puppet according to claim 7 having an artificial thumb which is exteriorly mounted on the body, said artificial thumb being visible to provide an illusion that the puppeteer's thumb is outside the body.

10. A puppet according to claim 7 wherein the actuator member is a lever which is mounted on a vertical pivot and a horizontal pivot, said vertical pivot being coincident with said first axis and permitting movement of said actuator member in said first direction to turn the head from a center position to positions which are rotationally displaced from said center position, said horizontal pivot permitting movement of said actuator member in said second direction to move the facial element relative to the head, said lever having first and second lever arms located on opposite sides of the horizontal pivot, said first lever arm being engageable by the puppeteer's thumb, and said second lever arm being connected to said movable facial element.

11. A puppet according to claim 10 wherein said first lever arm is inclined downwardly and rearwardly at all positions of the lever to enable the puppeteer's thumb to engage the lever both when the lever is at said center positions and at said rotationally displaced positions.

12. A puppet according to claim 1 wherein said horizontal space for receiving a puppeteer's thumb is disposed rearwardly of said first axis.

* * * * *